US010115539B2

(12) United States Patent
Wu et al.

(10) Patent No.: US 10,115,539 B2
(45) Date of Patent: Oct. 30, 2018

(54) LUMINATED KEY STRUCTURE AND ELECTRONIC DEVICE WITH THE SAME

(71) Applicant: Chiun Mai Communication Systems, Inc., New Taipei (TW)

(72) Inventors: Hung-Chen Wu, New Taipei (TW); Huan-Chang Chung, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/859,749

(22) Filed: Jan. 2, 2018

(65) Prior Publication Data

US 2018/0233303 A1 Aug. 16, 2018

(30) Foreign Application Priority Data

Feb. 16, 2017 (CN) ..... 2017 1 0083165

(51) Int. Cl.
*H01H 13/02* (2006.01)

(52) U.S. Cl.
CPC ..... *H01H 13/023* (2013.01); *H01H 2219/06* (2013.01); *H01H 2219/062* (2013.01)

(58) Field of Classification Search
CPC ..... H01H 13/023; H01H 2219/06; H01H 2219/062
See application file for complete search history.

(56) References Cited

U.S. PATENT DOCUMENTS

2006/0065514 A1* 3/2006 Toyama ..... H01H 13/023 200/310
2008/0030975 A1* 2/2008 Miyashita ..... G02B 6/0018 362/23.04
2008/0129551 A1* 6/2008 Gao ..... H01H 13/83 341/22
2012/0013490 A1* 1/2012 Pance ..... G06F 3/0202 341/28

FOREIGN PATENT DOCUMENTS

CN 204187535 U 3/2015
JP 2008269927 A 11/2008

* cited by examiner

*Primary Examiner* — Mary Ellen Bowman
(74) *Attorney, Agent, or Firm* — ScienBiziP, P.C.

(57) ABSTRACT

An illuminated key structure and electronic device with the key structure includes a substrate, a light guiding element, a key body, a first reflection film, and a second reflection film. The substrate has a light emitting element disposed on a substrate surface thereof. The light guiding element includes a main body and a light guiding portion. The main body has a first and second surfaces. The light guiding portion is on the first surface and forms, together with the first surface cooperatively, a receiving space for receiving the key body. The first reflective film is disposed on the second surface, and the second reflective film is disposed on the substrate surface. Light from the light emitting element is repeatedly reflected between the first reflection film and the second reflection film before being transmitted out of the key structure through the light guiding portion.

18 Claims, 4 Drawing Sheets

LUMINATED KEY STRUCTURE AND ELECTRONIC DEVICE WITH THE SAME

CROSS-REFERENCE TO RELATED APPLICATIONS

This application claims priority to Chinese Patent Application No. 201710083165.3 filed on Feb. 16, 2017.

FIELD

The subject matter herein generally relates to keyboard structures, and particularly to a key structure having a uniform luminous effect and an electronic device with the key structure.

BACKGROUND

Buttons or press keys are widely used in electronic devices. A light source is usually placed under a press key to brighten the press key through a light guide. However, since the light of the light source is transmitted completely through the light guide, the transmitted light is not evenly distributed around the press key.

BRIEF DESCRIPTION OF THE DRAWINGS

Implementations of the present technology will now be described, by way of example only, with reference to the attached figures.

DETAILED DESCRIPTION

Figure 1:
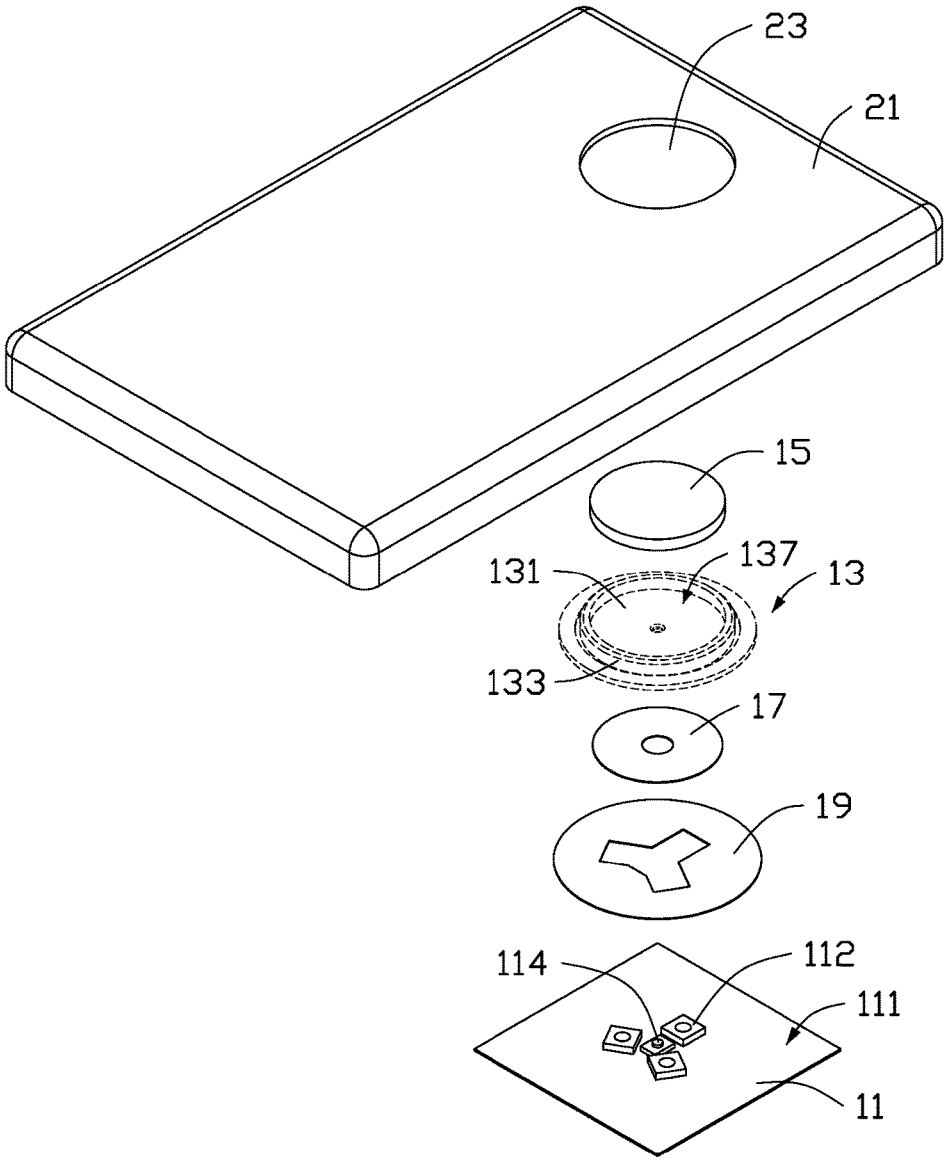
FIG. 1 is a exploded view illustrating an exemplary embodiment of a key structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to", it specifically indicates open-ended inclusion or membership in a so-described combination, group, series, and the like.

Figure 2:
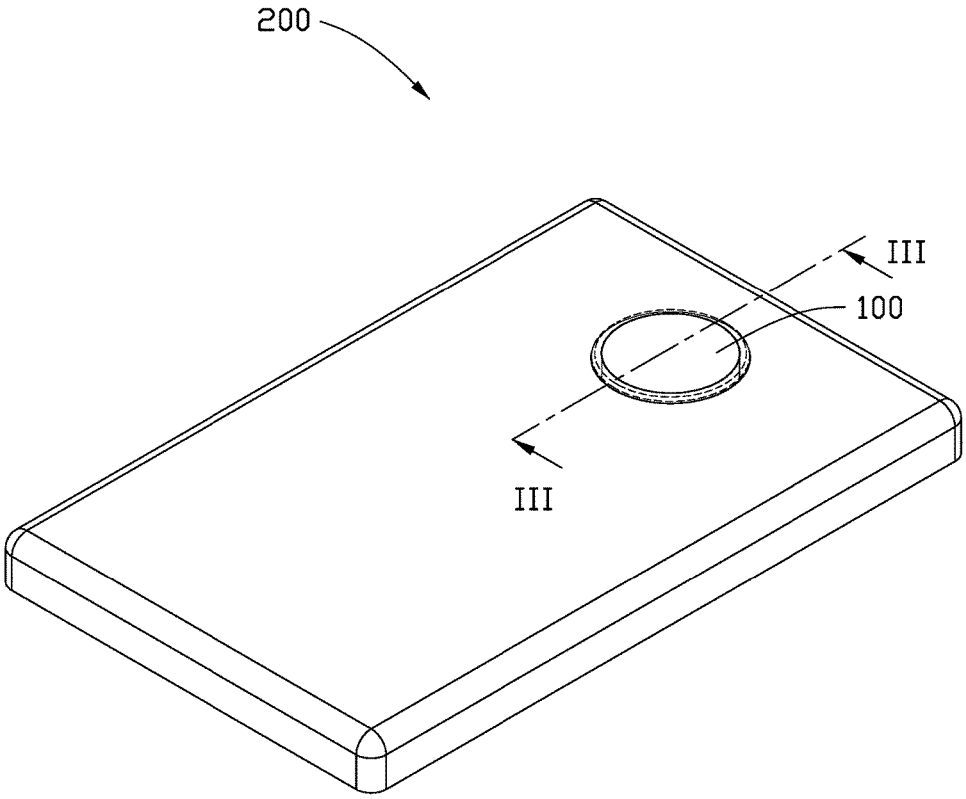
FIG. 2 is a perspective view illustrating an exemplary embodiment of the key structure of FIG. 1.

FIG. 1 and FIG. 2 illustrate an exemplary embodiment of a key structure 100. The key structure 100 can be used in, but is not limited to, an electronic device 200, such as a mobile phone, a tablet computer, and the like. The electronic device 200 includes a housing 21. An opening 23 is formed in the housing 21. The key structure 100 is received in the housing 21, and a part of the key structure 100 extends out of the housing 21 through the opening 23.

The key structure 100 includes a substrate 11, a light guiding element 13, a key body 15, a first reflective film 17, and a second reflective film 19.

Figure 3:
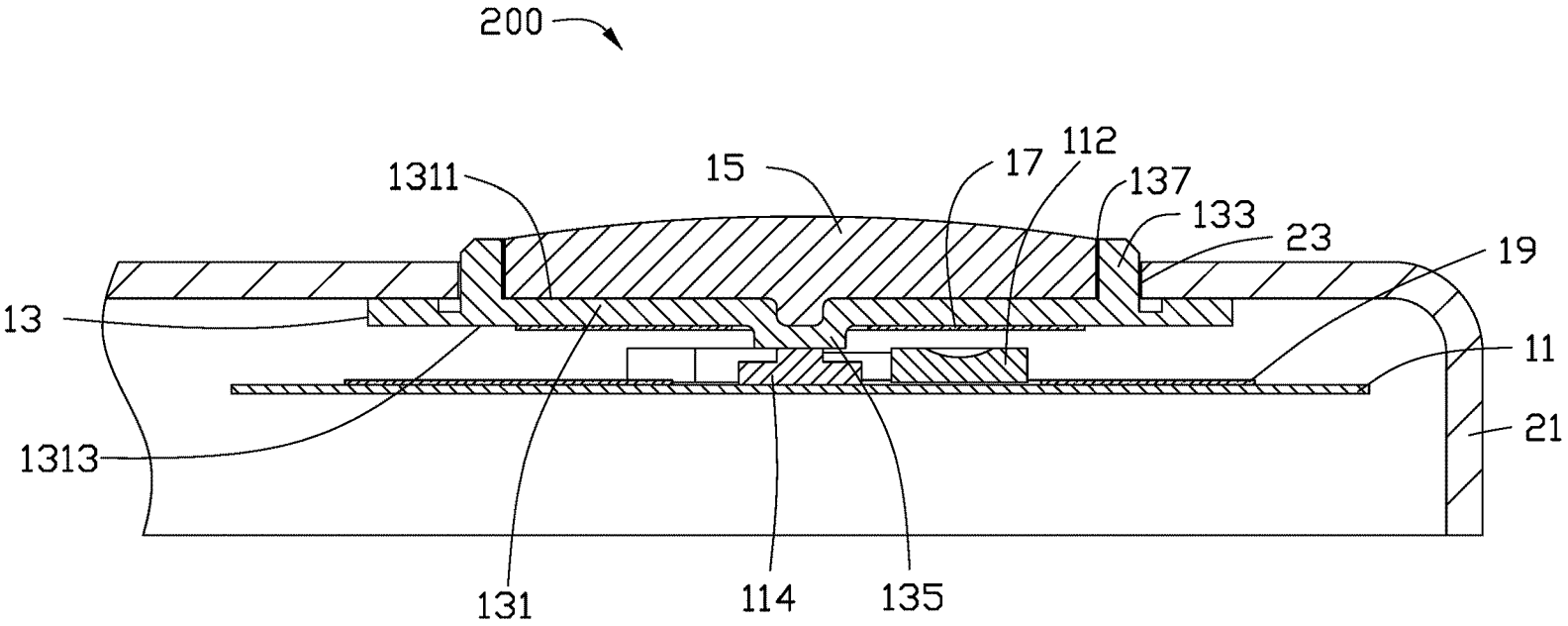
FIG. 3 is a cross-section view taken along line III-III of FIG. 2.

Referring to FIG. 3, in the exemplary embodiment, the substrate 11 can be a circuit board. The substrate 11 includes at least one light emitting element 112 disposed on a substrate surface 111 thereof. The at least one light emitting element 112 can be a light emitting diode or a lamp bulb. In the embodiment shown as FIG. 3, the substrate 11 includes three light emitting elements 112. In other embodiments, the number of the light emitting element 112 can be adjusted as needed. The substrate 11 further includes a switch 114.

The light guiding element 13 is disposed opposite to the substrate 11. The light guiding element 13 is made of optical transmission material. The light guiding element 13 includes a main body 131, a light guiding portion 133, and a pressing portion 135. The main body 131 is a circular plate. The main body 131 is parallel with the substrate 11 and is spaced from the substrate with a gap. The main body 131 includes a first surface 1311 and a second surface 1313. A shape of the light guiding portion 133 matches the shape of a contour of the key body 15. In the embodiment, the light guiding portion 133 projects from the first surface 1311. In the embodiment, the light guiding portion 133 is an annular projection. The light guiding portion 133 and the first surface 1311 cooperatively form a receiving space 137. The receiving space 137 is configured to receive the key body 15. The pressing portion 135 projects from the second surface 1313 of the main body 131 and a free end of the pressing portion 135 is disposed corresponding to the switch 114. In this embodiment, the pressing portion 135 contacts the switch 114. When the key body 15 is pressed, the key body 15 drives the light guiding element 13 to move toward the substrate 11 within the gap, so that the pressing portion 135 is driven to press the switch 114. The switching function of the switch 114 is thereby triggered.

It can be understood that, in the embodiment, the key body 15 is made of opaque material, such as opaque glass, opaque plastic, or opaque rubber. The light guiding element 13 is made of optical transmission material, such as transparent or translucent glass, transparent or translucent plastic, or transparent or translucent rubber. In other embodiments, only a part of the light guiding element 13 is made of optical transmission material, and other portion of the light guiding element 13 is made of opaque material. For example, the light guiding portion 133 and a portion corresponding to the light guiding portion 133 of the main body 13 can be made of optical transmission material, and other portion of the light guiding element 13 can be made of opaque material.

The first reflective film 17 is configured to transmit and reflect light. In the exemplary embodiment, the first reflective film 17 is made of reflective material. The first reflective film 17 is disposed on the second surface 1313 of the main body 131. In the embodiment, the first reflective film 17 only covers a portion of the second surface 1313 corresponding to the key body 15.

The second reflective film 19 is configured to transmit and reflect light. In the exemplary embodiment, the second reflective film 19 is made of reflective material. The second reflective film 19 is disposed on a substrate surface, on which the light emitting element 112 is disposed, of the substrate 11, and the light emitting element 112 and the switch 114 are exposed from the second reflective film 19.

Figure 4:
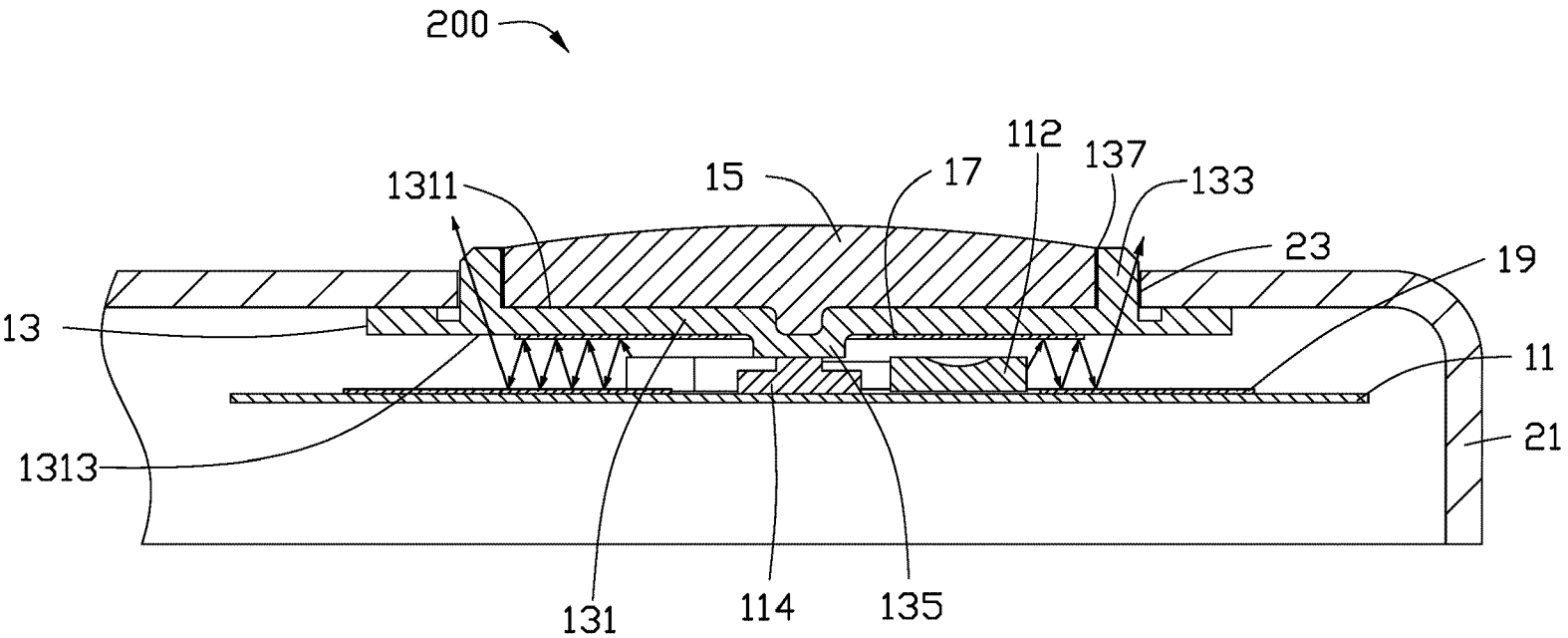
FIG. 4 is a cross-section view showing a path of the light travelling in the key structure.

Referring to FIG. 4, when light is emitted from the light emitting element 112, the light is reflected between the first reflective film 17 and the second reflective film 19 and is transmitted to the light guiding portion 133 through another portion of the second surface 1313, which is not covered by the first reflective film 17. The light is then transmitted out of the key structure 100 through the light guiding portion 133. In the embodiment, the reflection of light between the first reflective film 17 and the second reflective film 19 and the transmission of light through the light guiding portion 133 provides a uniform light to the key structure 100.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A key structure comprising:

a substrate having at least one light emitting element disposed on a substrate surface thereof;

a light guiding element being made of optical transmission material and disposed opposite to the substrate; wherein the light guiding element comprises a main body and a light guiding portion, and the main body comprises a first surface and a second surface opposite to the first surface, wherein the light guiding portion projects from the first surface, and the light guiding portion and the first surface cooperatively form a receiving space;

a key body being mad of opaque material and received in the receiving space;

a first reflective film being disposed on the second surface;

a second reflective film being disposed on the substrate surface of the substrate;

wherein when light is emitted from the at least one light emitting element, the light is reflected between the first reflective film and the second reflective film, transmitted to the light guiding portion, and transmitted out of the key structure through the light guiding portion.

2. The key structure of claim 1, wherein the at least one light emitting element is a light emitting diode or a lamp bulb.

3. The key structure of claim 1, wherein a portion of the main body corresponding to the key body is made of opaque material.

4. The key structure of claim 1, wherein the main body is a circular plate, and the light guiding portion is an annular projection projected from the first surface.

5. The key structure of claim 1, wherein the main body is parallel with the substrate and is spaced from the substrate with a gap, and a switch is disposed on the substrate; and wherein when the key body is pressed, the key body drives the light guiding element to press the switch.

6. The key structure of claim 5, wherein the light guiding element comprises a pressing portion projected from the second surface of the main body, the pressing portion is disposed corresponding to the switch; and wherein the pressing portion is configured to be driven to press the switch.

7. The key structure of claim 6, wherein the pressing portion is made of opaque material.

8. The key structure of claim 1, wherein the first reflective film covers a portion of the second surface corresponding to the key body.

9. The key structure of claim 1, wherein the at least one light emitting element is exposed from the second reflective film.

10. An electronic device comprising:

a housing comprising an opening;

a key structure received in the housing, a part of the key structure extending out of the opening, the key structure comprising:

a substrate having at least one light emitting element disposed on a substrate surface thereof;

a light guiding element being made of optical transmission material and disposed opposite to the substrate; wherein the light guiding element comprises a main body and a light guiding portion, and the main body comprises a first surface and a second surface opposite to the first surface, wherein the light guiding portion projects from the first surface, and the light guiding portion and the first surface cooperatively form a receiving space;

a key body being mad of opaque material and received in the receiving space;

a first reflective film being disposed on the second surface;

a second reflective film being disposed on the substrate surface of the substrate;

wherein when light is emitted from the at least one light emitting element, the light is reflected between the first reflective film and the second reflective film, transmitted to the light guiding portion, and transmitted out of the key structure through the light guiding portion.

11. The electronic device of claim 10, wherein the at least one light emitting element is a light emitting diode or a lamp bulb.

12. The electronic device of claim 10, wherein a portion of the main body corresponding to the key body is made of opaque material.

13. The electronic device of claim 10, wherein the main body is a circular plate, and the light guiding portion is an annular projection projected from the first surface.

14. The electronic device of claim 10, wherein the main body is parallel with the substrate and is spaced from the substrate with a gap, and a switch is disposed on the substrate; and wherein when the key body is pressed, the key body drives the light guiding element to press the switch.

15. The electronic device of claim 14, wherein the light guiding element comprises a pressing portion projected from the second surface of the main body, the pressing portion is disposed corresponding to the switch; and wherein the pressing portion is configured to be driven to press the switch.

16. The electronic device of claim 15, wherein the pressing portion is made of opaque material.

17. The electronic device of claim 10, wherein the first reflective film covers a portion of the second surface corresponding to the key body.

18. The electronic device of claim 10, wherein the at least one light emitting element is exposed from the second reflective film.

* * * * *